US005408298A

United States Patent [19]

Fukami et al.

[11] Patent Number: 5,408,298

[45] Date of Patent: Apr. 18, 1995

[54] IMAGE FORMING APPARATUS

[75] Inventors: Toshiyuki Fukami; Masashi Tanaka, both of Osaka, Japan

[73] Assignee: Mita Industrial Co., Ltd., Osaka, Japan

[21] Appl. No.: 202,362

[22] Filed: Feb. 25, 1994

[30] Foreign Application Priority Data

Mar. 1, 1993 [JP] Japan ..... 5-040133

[51] Int. Cl.[6] ..... G03G 21/00

[52] U.S. Cl. ..... 355/211; 355/210; 355/215; 430/49; 430/56; 430/133

[58] Field of Search ..... 355/200, 210, 211, 212, 355/213, 215, 219, 221; 430/49, 56, 57, 58, 59, 133

[56] References Cited

U.S. PATENT DOCUMENTS 4,363,711 12/1982 Kuehnle ..... 430/133 X
5,324,610 6/1994 Tanaka et al. ..... 430/58 X
5,336,576 8/1994 Miyamoto et al. ..... 430/58
5,339,138 8/1994 Mishima et al. ..... 355/215 X

*Primary Examiner*—A. T. Grimley
*Assistant Examiner*—Sandra L. Brasé
*Attorney, Agent, or Firm*—Sherman and Shalloway

[57] ABSTRACT

The image forming apparatus in this invention uses a positive corona discharger as a main charger. A photosensitive material having a charge accepting ability per run-off current of at least 40 V/μA from a corona discharger (measured by using a discharge length of 230 mm and by taking the peripheral speed of the photosensitive material as 48 mm/sec) is used, and a DC voltage is impressed on the positive corona discharger so that the average ozone concentration of an atmosphere of the photosensitive material 2 ppm or less and the ozone concentration immediately below the corona discharger becomes 5 ppm or less to perform main charging. According to this apparatus, the amount generated of ozone can be decreased, and charging unevenness can be prevented to form a good image.

5 Claims, 3 Drawing Sheets

IMAGE FORMING APPARATUS

BACKGROUND OF THE INVENTION

1. Field of the Invention

The present invention relates to an image forming apparatus used in a copying machine or a laser printer. More specifically, it relates to an image forming apparatus in which the generation of ozone by corona charging can be prevented effectively and a photosensitive drum is not scratched and the photosensitive drum has a long service life.

2. Description of the Prior Art

In electrophotographic copying machines, a high voltage is supplied by corona discharge. When a corona discharge is generated, oxygen in air is oxidized to generate ozone. The ozone gives rise to a problem of environmental pollution, or a problem of deteriorating the photosensitive material.

Many photosensitive materials now in practical use are negatively charged. In the negatively charged organic photosensitive materials, the amount of ozone generated for utilizing a negatively corona discharging is especially large.

Various proposal have previously been made in order to prevent the generation of ozone by corona discharge in such an image forming apparatus. For example, it is known to provide a method which comprises contacting a soft fibrous contacting piece with a material to be charged, thereby to electrify the material (Japanese Laid-Open Patent Publication No. 269975/1987).

However, the method of electrification by contacting a material to be charged may charge a photosensitive material drum without using corona discharge and therefore prevent the generation of ozone. But since the contacting piece carries out electrification by scratching the surface of the photosensitive drum which is a material to be charged, it is likely that a scratch may be formed on the surface of the drum. Furthermore, because a high electric field is formed between the forward end of the contacting piece and the photosensitive drum, the current leaks to form pinholes in the photosensitive drum and leads to defects such as the short service life of the photosensitive material drum.

Furthermore, it is difficult to contact the contacting piece uniformly with the surface of the photosensitive material drum. Although it may be possible to apply a high voltage to a portion directly contacted, it is difficult to fully electrify a portion which the contacting piece does not directly contact. This leads to a problem that electrification unevenness occurs in the surface of the photosensitive material drum.

Furthermore, when cleaning is insufficient in the photosensitive material drum, the toner or the paper powder remains on the photosensitive material drum. When a charging treatment is carried out by the above method on the photosensitive material drum which is insufficiently cleaned, the toner, etc. remaining on the drum contaminates the contacting piece, and electrification unevenness will occur. Such uneven electrification adversely affects the formation of an image, and unpreferably cannot obtain a good time.

SUMMARY OF THE INVENTION

An object of this invention is to provide an image forming apparatus which can decrease the amount of ozone generated, prevent the scratching of the photosensitive material drum and prolong the service life of the photosensitive material drum.

Another object of this invention is to provide an image forming apparatus which can prevent electrification unevenness and can form a good image.

According to this invention, there is provided an electrophotographic image forming apparatus comprising a photosensitive material, a positive corona charger an imagewise exposing device, a developing device, and a transfer roller by negative charging, wherein the photosensitive material is a photosensitive material having a charge accepting ability of at least 40 V/μA per run-off current from a corona discharger at a time when the peripheral speed of the photosensitive material is 48 mm/sec. using the corona discharger having a discharge length of 230 mm and a DC voltage is impressed to the corona discharger so that the average ozone concentration in an atmosphere of the photosensitive material is 2 ppm or less and the ozone concentration immediately below the corona discharger is 5 ppm or less.

DETAILED DESCRIPTION OF THE INVENTION

As stated above, the generation of ozone by corona discharge is marked when a negative polar corona discharge is utilized. Accordingly, a positive corona discharger is used when charging of the photosensitive material requires a high voltage and a negative charging is carried out by roller transfer at the time of transferring (by using a so-called reversal development method), whereby the generation of ozone can be suppressed markedly as compared with the case of using the negative polar corona discharge.

Figure 1:
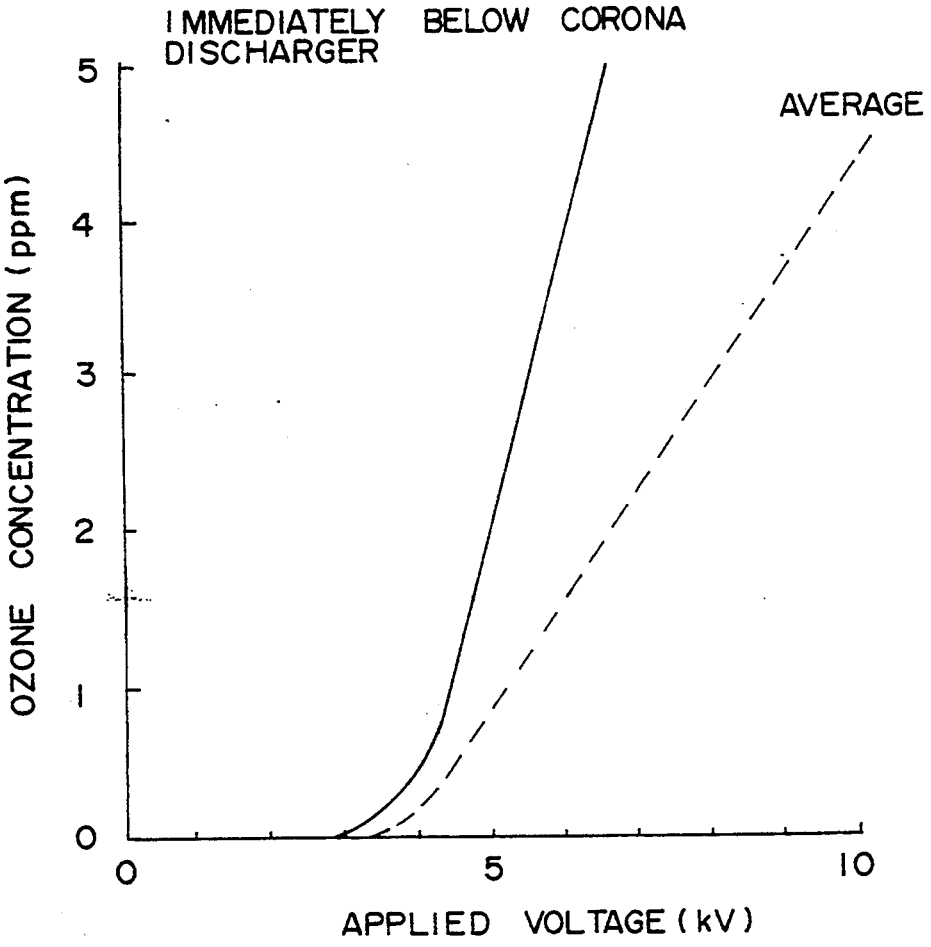
FIG. 1 is a diagram showing the relation between the applied voltage of the corona discharger and the concentration of ozone.

When charging is generally carried out by corona discharge, the amount of ozone generated is proportional to the voltage applied to the corona discharger as shown in FIG. 1. If the voltage applied to the corona discharger is made small, the amount of ozone can be decreased. If the applied voltage is small, it becomes difficult to fully electrify the photosensitive material. Since the photosensitive material used in this invention has a high charge accepting ability of at least 40 V/μA per run-off current from the corona discharger, it is possible to supply sufficient charge without applying a high voltage. Thus, the abovementioned positive corona discharger is used, and the generation of ozone can be effectively suppressed.

Figure 2:
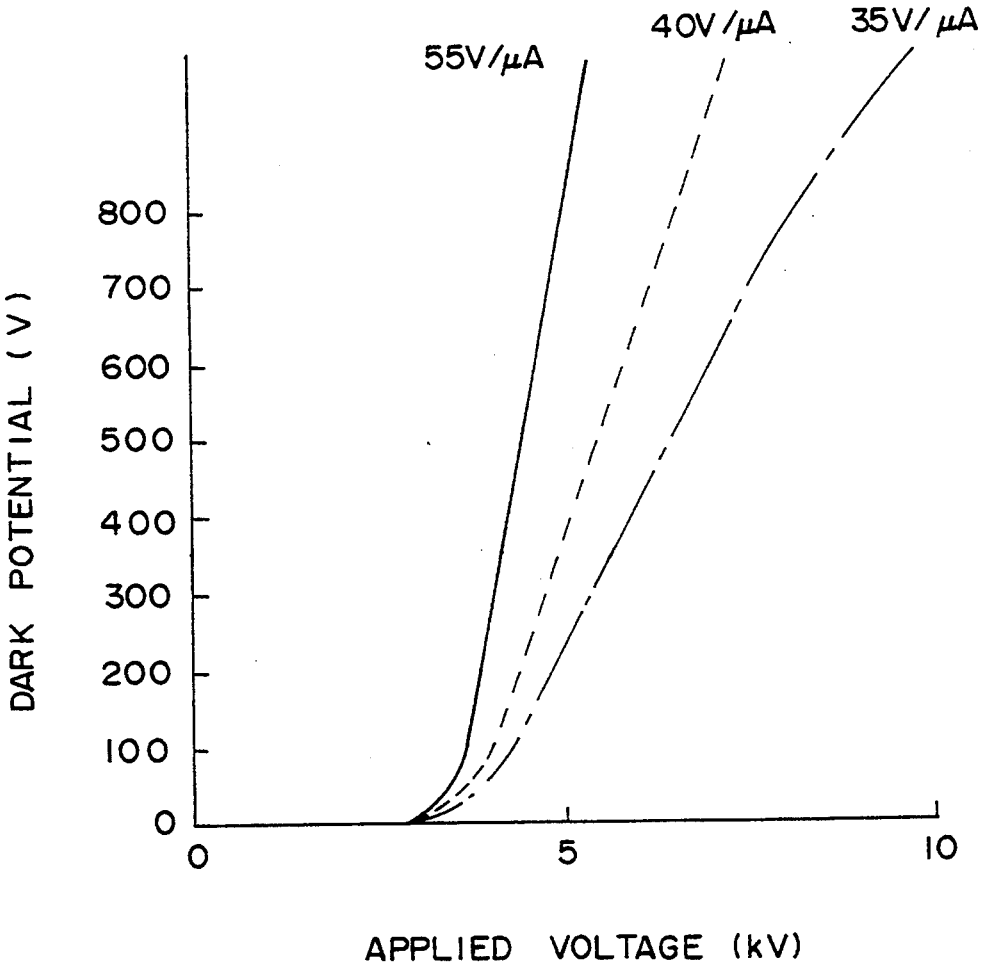
FIG. 2 is a diagram showing the relation between the applied voltage of the corona discharger and the dark potential when the charge accepting ability of the photosensitive material is a specified value.

It is specified that the charge accepting ability of the photosensitive material is adjusted to at least 40 V/μA per run-off current from the corona discharger. As is clear from FIG. 2, if the charge accepting ability is less than 40 V/μA, the charge accepting ability begins to decrease when the dark potential exceeds 700 (V). Accordingly, it becomes difficult to apply a sufficient voltage with the least possible voltage applied.

The above-mentioned charge accepting ability is a value when discharge is carried out by adjusting the peripheral speed of the photosensitive material to 48 mm/sec using a corona discharger having a discharge length of 230 mm.

Figure 3:
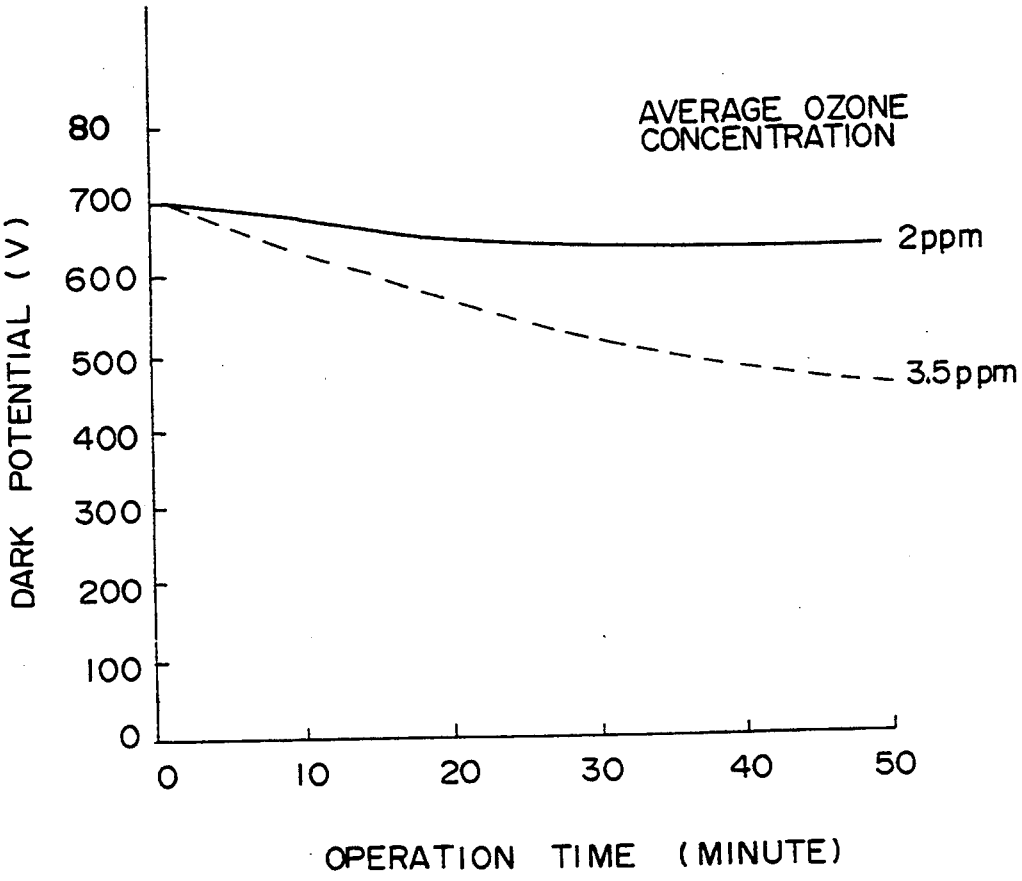
FIG. 3 is a diagram showing the relation between the operation time and the dark potential when the average ozone concentration is a specified value.

As stated above, the ozone concentration is proportional to the applied voltage of the corona discharger. In the present invention, the applied voltage is adjusted so that the average ozone concentration in an atmosphere of the photosensitive material is 2 ppm or less and the ozone concentration immediately below the corona discharger is 5 ppm or less. It is for the following reason. The ozone concentration is highest immediately below the corona discharger as a generator of ozone, and ozone is diffused in an atmosphere of the photosensitive material and adversely affects the photosensitive material. As shown in FIG. 3, when the average ozone concentration in the atmosphere of the photosensitive material becomes higher than the average ozone concentration, the dark potential of the photosensitive material decreased with the passage of time. However, when the ozone concentration is 2 ppm, the dark potential reaches an equilibrium state, and hardly charges. As FIG. 1 shows, it has been experimentally found that when the ozone concentration in the atmosphere of the photosensitive material is 2 ppm, the ozone concentration immediately below the corona discharger shows a value of 5 ppm.

The amount of ozone generated is adjusted by the applied voltage of the corona discharger within a range which does not adversely affect the photosensitive material, namely so that the average ozone concentration of the atmosphere of the photosensitive material is adjusted to 2 ppm or less, and the ozone concentration immediately below the corona discharger is adjusted to 5 ppm or less. As a result, the deterioration of the drum of the photosensitive material is prevented and the service life of the drum of the photosensitive material can be prolonged.

The present inventors have succeeded in preventing the deterioration of the properties of the photosensitive material even if the average ozone concentration rises to about 2 ppm, which is higher than ordinary cases, by adjusting the charge accepting ability of the photosensitive material to at least a certain amount. This is also an advantage of the present invention.

Figure 4:
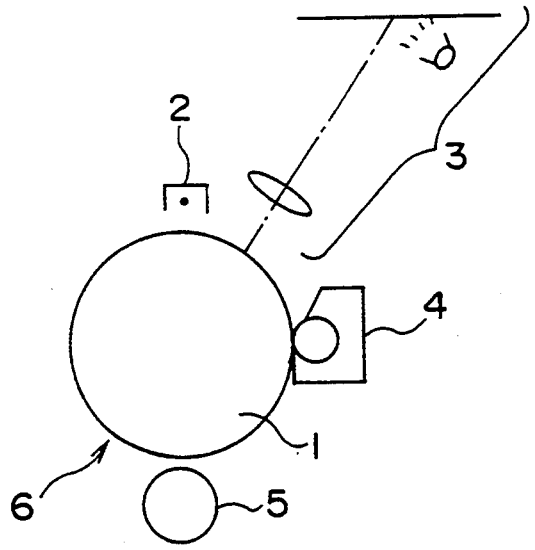
FIG. 4 is a view showing a rough arrangement of the image forming apparatus of the invention.

In FIG. 4 showing a rough arrangement of the image forming apparatus of this invention, along the circumference of the photosensitive drum 1, a positive corona discharger 2 for positively electrifying the surface of the photosensitive material, an exposing device 3 for imagewise exposing the charged photosensitive material, a development device 4 for developing an electrostatic image formed on the photosensitive material with a toner, a transfer roller 5 for transferring the toner image formed on the surface of the photosensitive material to a receptive paper, and a light source 6 for eliminating a residual charge on the drum of the photosensitive material are provided.

According to the image-forming apparatus, the surface of the photosensitive drum 1 is positively charged uniformly by the positive corona discharger 2, and then a document is imagewise exposed by the exposing device 3. The electrical potential of the exposed portion (a portion corresponding to the image of the document) is decreased. On the other hand, the surface potential is maintained as it is in the non-exposed portion (background portion), and an electrostatic image is formed. If further necessary, while a negative bias voltage is being impressed to the photosensitive drum 1, a known positively charged toner is scattered by the developing device 4 to develop the electrostatic image and a toner image is formed. On the other hand, the transfer roller 5 is obtained, for example, by forming an electroconductive rubber layer containing a conductive agent on an electroconductive core roller, and a negative bias voltage is impressed on it. Hence, by passing a transfer paper, etc. between the photosensitive drum 1 and the transfer roller 5, a toner image formed on the drum 1 is transferred to the transfer paper. After the transfer, a charge remaining on the drum surface is erased by light irradiation with the charge eliminating lamp 6.

In the above positive charging, FIG. 1 clearly shows that by impressing a direct current voltage of 4.8 to 6.6 KV to the positive corona discharger 2, the average ozone concentration in an atmosphere of the photosensitive drum 1 is adjusted to 2 ppm or less, and the ozone concentration immediately below the discharger is adjusted to 5 ppm or less.

The photosensitive material having a charge accepting ability of at least 40 V/μA, preferably at least 50 V/μA, may be mono-layer dispersed type organic photosensitive materials composed of a combination of a hole transporting agent having a specified ionized potential and an electron transporting agent such as diphenoquinone derivatives, especially a non-symmetrical substitution type, dispersed in a resin medium.

This photosensitive material can be positively charged, has a residual potential suppressed at a low level and shows an excellent sensitivity to positive charging. Specifically, an organic photosensitive material in which the organic photosensitive layer is a composition comprising a charge generating agent dispersed in a resin medium, a diphenoquinone derivative as an electron transporting agent, and a hole transporting agent having an ionized potential of 4.8 to 5.6 eV can be used preferably. The diphenoquinone derivatives forming the photosensitive materials used in the present invention are compounds of the following general formula

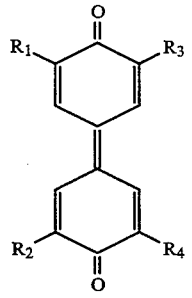

wherein each of $R_1$, $R_2$, $R_3$, and $R_4$ represents a hydrogen atom, an alkyl group, a cycloalkyl group, an aryl group and an aralkyl group, etc.

Suitable examples of the above compounds include 3,5-dimethyl-3′,5′-di-butyldiphenoquinone, 3,3′-dimethyl-5,5′-dit-butylphenoquinone, 3,5′-dimethyl-3′,5-dit-butyldiphenoquinone, 3,5,3′,5′-tetramethyldiphenoquinone, 3,5,3′,5′-tetrat-butyldiphenoquinoe, 3,5,3′,5′-tetraphenyldiphenoquinone and 3,5,3′5′-tetracyclohexyldiphenoquinone. Diphenoquinone derivatives having the substituents satisfying the relation (1), (2) or (3) have a small interaction among molecules because of a low symmetry of molecules, and have good solubility.

(Number of carbon atoms of $R_1$=number of carbon atoms of $R_3$)>(number of carbon atoms of $R_2$=number of carbon atoms of $R_4$) (1)

(Number of carbon atoms of $R_1$=number of carbon atoms of $R_2$)>(number of carbon atoms of $R_3$=number of carbon atoms of $R_4$) (2)

(Number of carbon atoms of $R_1$=number of carbon atoms of $R_4$)>(number of carbon atoms of $R_2$=number of carbon atoms of $R_3$) (3)

These diphenoquinone derivatives may be used singly or in a mixture of at least two.

In addition to the diphenoquinone derivatives, benzoquinone derivatives, naphthoquinone derivatives, anthraquinone derivatives, dibenzoquinone derivatives, dinaphthoquinone derivatives, phenonaphthoquinone derivatives and phenoanthraquinone derivatives may also be used as the electron transporting agents.

Any desired hole transporting substances which satisfy the above conditions may be used in this invention. Examples of the hole transporting substances may have an ionized potential of 4.8 to 5.6 eV among nitrogen-containing cyclic compounds and condensed polycyclic compounds such as oxadiazole compounds, styryl compounds, carbazol compounds, organic polysilane compounds, pyrazoline compounds, hydrazone compounds, triphenylamine compounds, indole compounds, oxazole compounds, isooxazole compounds, thiazole compounds, imidazole compounds, pyrazole compounds, and triazole compounds. Preferably, they may have an electric field strength of $3\times10^5$ V/cm and a movement degree of at least $10^{-6}$ Vcm.

Preferred hole transporting agents include 1,1-bis(p-diethylaminophenyl)-4,4-diphenyl-1,3-butadiene, N,N'-bis(o,p-dimethylphenyl)-N,N'-diphenylbenzidine, 3,3'-dimethyl-N,N,N',N'-tetrakis-(4-methylphenyl-1,1'-biphenyl)-4,4'-diamine, N-ethyl-3-carbazoylaldehyde-N,N'-diphenylhydrazone and 4-(N,N-bis(p-tolyl-)amino)-β-phenylstilbene.

Examples of the charge generating agent include selenium, selenium-tellurum, amorphous silicon, a pyrylium salt, azoic pigments, disazoic pigments, anthanthrone-type pigments, phthalocyanine pigments, indico-type pigments, threne-type pigments, toluidine-type pigments, pyrazoline-type pigments, perylene-type pigments, and quinacridone-type pigments. They are used singly or in mixtures of at least two members. Preferably, they have an ionized potential of 4.8 to 5.6 eV. Especially preferred are X-type metal-free phthalocyanine and oxotitanyl phthalocyanine.

As a general tendency, by making Ip of the hole transporting agent larger than the ionized potential (Ip) of the charge generating agent, the charge accepting ability becomes higher; but if the difference between the two is too larger, disadvantage occurs in regard to the photosensitivity. Accordingly, to prepare a photosensitive material having a charge accepting ability within the above-mentioned range, it is preferred to select the hole transporting agent and the charge generating agent so that the Ip of the hole transporting agent becomes a little bit larger than the Ip of the charge generating agent.

Various resins may be used as the resin medium in which each component is dispersed. They include olefinic polymers such as styrene-type polymers, acrylic polymers, styrene-acrylic polymers, an ethylene-vinyl acetate copolymer, polypropylene and ionomers; and thermosetting resins such as polyvinyl chloride, a vinyl chloride-vinyl acetate copolymer, polyesters, alkyd resins, polyamides, polyurethane, epoxy resins, polycarbonate, polyallylate, polysulfone, diallyl phthalate resin, silicone resin, ketone resin, polyvinyl butyral resin, polyether resins, phenol resins and epoxyacrylate. These resin may be used singly or an mixtures of at least two members. Suitable resins include styrene-type polymers, acrylic polymers, styrene-acylic polymers, polyesters, alkyd resins, polycarbonate and polyallylate.

In mono-layer type photosensitive materials, there is a tendency that as the concentration of the charge generating agent is higher, the charge accepting ability becomes smaller. Accordingly, to obtain a photosensitive material having a charge accepting ability with the aforementioned range, the charge generating agent may be used in an amount of 0.1 to 5% by weight, especially 0.25 to 2.5% by weight, based on the solid in the photosensitive layer. Furthermore, the diphenoquinone derivative or another electron transporting agent (ET) may be used in an amount of 5 to 50% by weight, especially 10 to 40% by weight, based on the solid, and the hole transporting agent (HT) may be used in an amount of 5 to 50% by weight, especially 10 to 40% by weight, based on the solid in the photosensitive layer. Furthermore, the ET:HT weight ratio is best adjusted to from 1:9 to 9:1, especially from 2:8 to 8:2.

The composition for forming a photosensitive material preferably used in this invention may contain various compounding agents which do not adversely affect the photographic characteristics, for example, antioxidants, radical scavengers, singlet quenchers, UV absorbing agents, softening agents, surface modifiers, defoamers, extenders, viscosity-increasing agents, dispersion stabilizers, waxes, acceptors, and donors.

In addition to the above components, the addition of a sterically hindered phenol-type antioxidant in an amount of 0.1 to 50% by weight based on the total solid content can markedly increase the durability of the photosensitive layer without adversely affecting the electrophotographic characteristics. Suitable antioxidants include 2,6-dit-butyl-p-cresol,

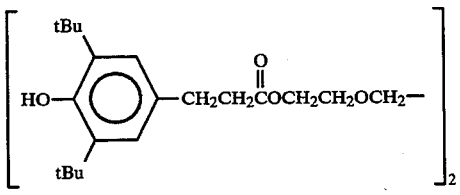

(tBu: tertiary butyl group, same as in the following)

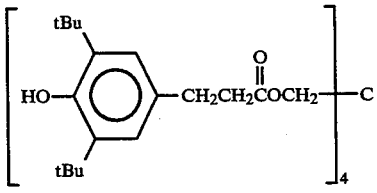

-continued

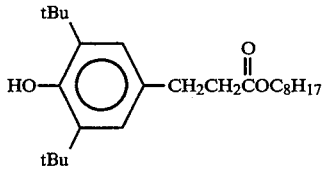

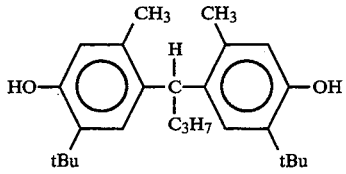

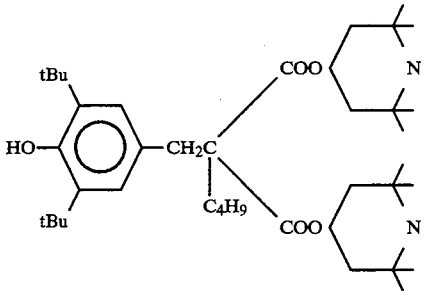

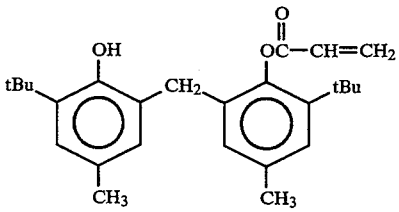

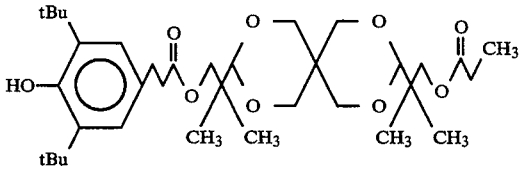

Various organic solvents may be used as solvents to form a coating solution for forming the photosensitive layer. Examples of the organic solvents include alcohols such as methanol, ethanol, isopropanol and butanol; aliphatic hydrocarbons such as n-hexane, octane and cyclohexane; aromatic hydrocarbons such as benzene, toluene and xylene; halogenated hydrocarbons such as dichloromethane, dichloroethane, carbon tetrachloride and chlorobenzene, dichloroethane, carbon tetrachloride and chlorobenzene; ethers such as dimethyl ether, diethyl ether, tetrahydrofuran, ethylene glycol dimethyl ether, diethylene glycol and dimethyl ether; ketones such as acetone, methyl ethyl ketone and cyclohexanone; esters such as ethyl acetate and methyl acetate; and dimethyl formamide and dimethyl sulfoxide. They may be used singly or as a mixture of at least two members. The concentration of the solid content of the coating solution may be generally 5 to 50%.

Various materials having electric conductivity may be used as electroconductive substrates. Examples of the electroconductive substrates include simple metals such as aluminum, copper, tin, platinum, gold, titanium, nickel, indium, stainless steel and brass; plastic materials on which the above metals are adhered by vaporization or lamination; and glass materials coated with aluminum iodide, tin oxide, indium oxide, etc.

The photosensitive material used in this invention is a mono-layer type photosensitive material, and does not develop interference fringes. It is advantageous therefore that an ordinary aluminum tube, especially a starting tube obtained by anodically oxidizing to provide a film thickness of 1 to 50 μm can be used.

The coating solution may be formed by preparing the charge generating material, etc. and the binder resin, etc. in accordance with a hitherto known method with the use of a roll mill, a ball mill, a paint shaker, an ultrasonic disperser, etc., coating them by a known coating means, and thereafter drying the coated layer.

In this case, as the dispersed state of the charge generating agent is higher, namely as the agglomerated portion is fewer and the charge generating agent is more uniformly dispersed, the charge accepting ability of the photosensitive material tends to become higher. Accordingly, the charge accepting ability of the photosensitive material can be adjusted by increasing the uniform dispersibility of the charge generating agent by using an ultrasonic disperser, etc.

The thickness of the photosensitive material is not particularly restricted. When this thickness is larger, the photosensitive material tends to exhibit a higher charge accepting ability. Thus, the charge accepting ability of the photosensitive material can be adjusted by adjusting the thickness of the film of the photosensitive layer. In the present invention, the thickness of the film is generally adjusted to 5 to 100 μm, preferably 10 to 50 μm, most preferably 16 to 30 μm.

(Examples) (Photosensitive Drum)

| Components | |
|---|---|
| Metal-free phthalocyanine (charge generating material; Ip = 4.98 eV) | 5 parts by weight |
| N,N'-bis(o,p-dimethylphenyl-N,N'-diphenylbenzidine (hole transporting material; Ip = 5.33 eV) | 40 parts by weight |
| 3,3',5,5'-tetraphenyl-diphenylquinone (electron transporting material) | 40 parts by weight |
| Polycarbonate (binder resin) | 100 parts by weight |
| Dichloromethane (solvent) | 800 parts by weight |

The above-mentioned components were mixed and dispersed by an ultrasonic disperser. The coating solution prepared was coated on an aluminum tube by immersion coating, and then dried by passing a hot air at 60° C. for 60 minutes to form a mono layer-type photosensitive drum shown in Table 1. (Each film thickness was obtained by adjusting the coating speed).

TABLE 1

| Photosensitive material | Thickness of the photosensitive layer (μm) | Charge accepting ability (V/μA) (*) |
|---|---|---|
| A | 25 | 55 |
| B | 18 | 40 |
| C | 15 | 35 |

(*): The charge accepting ability was measured by using a corona discharger having a discharge length of 230 mm and adjusting the peripheral speed of the photosensitive material to 48 mm/sec.

(Image Forming Apparatus)

In the following Examples and Comparative Examples, the image forming apparatus described below was used.

As shown in FIG. 4, an electrophotographic apparatus constructed by arranging a corona charger 2 for main charging, an imagewise exposing optical system (laser light) 3, a developer 4, a transfer roller 5 and a charge eliminating light source 6 around the mono-layer type photosensitive drum 1 was used.

Examples 1 and 2 and Comparative Examples 1 to 3

The mono-layer type photosensitive drum A shown in Table 1 was-mounted on the image forming apparatus (FIG. 4) shown above. The corona charger 2 for main charging, the imagewise exposing optical system (laser light) 3, and the charge eliminating light source 6 were turned on, and a voltage was applied so that the initial surface potential (dark potential) became +700 V. While maintaining the applied voltage, the exhaust within the copying apparatus was adjusted to control the average ozone concentration of the applied voltage the periphery of the drum at various values. Charging-exposing-charge elimination were repeated for 50 minutes to perform an ozone exposure test to measure the dark potential before and after the test and the ozone concentration immediately below the charger. The results are shown in Table 2.

The measurement of the dark potential was measured by a surface electrometer.

Measurement of the ozone concentration:

An ozone monitor (EG-2001D, made by Ebara Jitsugyo Co., Ltd.) was disposed on a pseudodrum, and the presudodrum was exchanged with the photosensitive drum and then the ozone concentration was measured. The drum periphery average means an average value calculated of the ozone concentration at every 45° of the periphery of the photosensitive drum measured about the corona charger for main charging as a center.

TABLE 2

| | Applied voltage to the min charger (KV) | Ozone concentration (ppm) | | Dark potential $V_0$ (V) | | $V_0$ (V) |
|---|---|---|---|---|---|---|
| | | Immediately below the main charger | Average of the periphery of the drum | Initial | After ozone exposure | Varied value |
| Example 1 | 6.6 | 5.0 | 2.0 | 703 | 632 | −71 |
| Example 2 | 5.3 | 3.1 | 1.2 | 708 | 696 | −12 |
| Comparative Example 1 | 7.3 | 7.2 | 3.5 | 705 | 448 | −257 |
| Comparative Example 2 | 6.9 | 5.3 | 2.0 | 699 | 599 | −100 |
| Comparative Example 3 | 6.7 | 5.0 | 2.3 | 701 | 593 | −108 |

Examples 3 and 4 and Comparative Example 4

Each of the mono-layer type photosensitive drum A, B and C was mounted on the image forming apparatus of FIG. 4. An applied voltage to the corona charger for main charging was adjusted so that the surface potential (dark potential $V_0$) of each of the photosensitive drums became +700 V. When the ozone concentration was stabilized, the ozone concentration was measured in the same way as above. The results are shown in Table 3.

TABLE 3

| | Photo-sensitive drum | Applied voltage at $V_0$ = 700 hours (KV) | Ozone concentration (ppm) | |
|---|---|---|---|---|
| | | | Immediately below the main charger | Drum peri-phery average |
| Example 3 | A | 4.8 | 1.72 | 0.72 |
| Example 4 | B | 6.1 | 4.29 | 1.65 |
| Comparative Example 4 | C | 7.5 | 6.96 | 2.65 |

Table 2 shows that charging unevenness was prevented by maintaining the ozone concentration within the range of the present invention in Example 1 and 2 (the average ozone concentration of 2 ppm or less and the ozone concentration immediately below the corona discharger of 5 ppm or less).

Table 3 shows that in Examples 3 and 4, even when the surface potential is maintained at 700 V required for usual image formation, the amount of ozone generated can be well decreased. In contrast, in Comparative Example 4, an applied voltage of 7.5 KV was required to charge the photosensitive drum to 700 V, and based on this fact, the amount of ozone generated increased.

What is claimed is:

1. An electrographic image forming apparatus comprising a photosensitive material, a positive corona charger, an imagewise exposing device, a developer device, and a transfer roller to be negatively charged, wherein the photosensitive material has a charge accepting ability of at least 40 V/μA per run-off current from a corona discharger at a time when the peripheral speed of the photosensitive material is taken as 48 mm/sec using the corona discharger having a discharge length of 230 mm, and a DC voltage is impressed to the corona discharger so that the average ozone concentration in an atmosphere of the photosensitive material is 2 ppm or less and the ozone concentration immediately below the corona discharger is 5 ppm or less.

2. An image forming apparatus of claim 1 wherein the photosensitive material is a mono-layer dispersed type organic photosensitive material.

3. An image forming apparatus of claim 1 wherein the mono-layer dispersed type organic photosensitive material contains a diphenoquinone derivative as an electron transporting agent in an organic photosensitive layer.

4. An image forming apparatus of claim 3 wherein the diphenoquinone derivative is expressed by the following formula

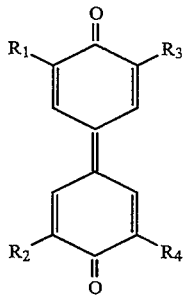
wherein each of $R_1$, $R_2$, $R_3$ and $R_4$ represents a hydrogen atom, an alkyl group, a cycloalkyl group, an aryl group or an aralkyl group.
5. An image forming apparatus of claim 1 wherein the DC voltage imparted to the positive corona discharger is 4.8 to 6.6 KV.
* * * * *